United States Patent [19]

Schütt

[11] Patent Number: 4,943,205

[45] Date of Patent: Jul. 24, 1990

[54] EARTH MOVING MACHINE

[76] Inventor: Heinz Schütt, Geibelstrasse 5, 7430 Metzingen, Fed. Rep. of Germany

[21] Appl. No.: 264,329

[22] Filed: Oct. 28, 1988

[30] Foreign Application Priority Data

Nov. 11, 1987 [DE] Fed. Rep. of Germany ..... 3738281

[51] Int. Cl.[5] ..... E02F 3/28

[52] U.S. Cl. ..... 414/680; 74/471 XY; 414/695.5; 414/687

[58] Field of Search ..... 340/709; 341/20; 414/680, 685, 687, 729, 690, 694, 695.5; 74/471 XY; 273/148 B; 446/426, 425, 424

[56] References Cited

U.S. PATENT DOCUMENTS

| | | | |
|---|---|---|---|
| 2,536,724 | 1/1951 | Clay | 414/690 |
| 3,144,146 | 8/1964 | Strickland, Jr. | 414/690 |
| 3,586,184 | 6/1971 | Pesavento et al. | 414/685 |
| 3,698,580 | 10/1972 | Carlson et al. | 414/687 X |
| 3,721,357 | 3/1973 | Williamson | 414/687 X |
| 3,799,362 | 3/1974 | Oswald et al. | 414/680 |
| 3,880,304 | 4/1975 | Strickland, Jr. | 414/687 X |
| 3,976,023 | 8/1976 | Noguchi et al. | 74/471 XY X |
| 4,019,401 | 4/1977 | Drone | 74/471 XY X |
| 4,027,547 | 6/1977 | Rahman | 74/471 XY X |
| 4,028,958 | 6/1977 | Schuermann et al. | 74/471 XY X |
| 4,098,286 | 7/1978 | Prime | 74/471 XY X |
| 4,216,467 | 8/1980 | Colston | 341/20 |
| 4,389,151 | 6/1983 | Brown | 74/471 XY X |
| 4,489,805 | 12/1984 | Okabe | 74/471 XY X |
| 4,614,476 | 10/1986 | Mello Ribeiro Pinto | 414/729 |
| 4,646,778 | 3/1987 | Tsuji et al. | 74/471 XY X |
| 4,736,647 | 4/1988 | Shimoie et al. | 74/471 XY X |
| 4,763,100 | 8/1988 | Wood | 74/471 XY X |

FOREIGN PATENT DOCUMENTS

| | | | |
|---|---|---|---|
| 709646 | 5/1965 | Canada | 74/471 XY |

*Primary Examiner*—Robert J. Spar
*Assistant Examiner*—James Eller
*Attorney, Agent, or Firm*—Michael J. Striker

[57] ABSTRACT

An earth moving machine comprises an earth moving tool, a plurality of drive elements arranged to move the earth moving tool in different directions, and a control unit operative for actuating the drive elements, the control unit including a single control member which is freely movable from an initial position toward all sides and additionally turnable about at least one turning axle, the control unit being further provided with at least one handle which is fixedly connected with the control member, the control unit also having sensors which respond to the movements of the control body in three mutually perpendicular directions and to the turning of the control body, the sensors being associated with the drive elements so that each of the drive elements causes a movement of the earth moving tool in a direction-synchronous manner with the movements and turning of the control member.

8 Claims, 2 Drawing Sheets

EARTH MOVING MACHINE

BACKGROUND OF THE INVENTION

The present invention relates to an earth moving machine with an earth moving tool which is movable by a plurality of drive elements in different directions, and in which the drive elements are controllable by a control unit actuated by handles.

The control unit of known earth moving machines, for example an excavator, has two handles for an operator who sits in or on the earth moving machine. The operator releases different control movements by both handles. Such a control unit requires an experienced driver who knows which movements of the earth moving tool can be controlled by left handle and which movements of the earth moving tool can be controlled by right handle, and how the handles must be displaced for performing the desired control movement. Experienced operators for earth moving machines are however specialists who are in high demand and highly paid, and in many working places especially in developing countries can not be hired.

SUMMARY OF THE INVENTION

Accordingly, it is an object of the present invention to provide an earth moving machine in which the control unit is formed so that the control of the earth moving machine can be performed by non-trained and non-experienced persons.

In keeping with these objects and with others which will become apparent hereinafter, one feature of the present invention resides, briefly stated, in an earth moving machine in which a control unit includes a single control member which is movable from an initial position toward all sides freely and provided with at least one handle which is turnable about at least one turning axis, and the control member cooperates with sensors which respond to the movements in three mutually perpendicular adjusting directions and at least one turning movement, wherein the driving elements are arranged so that each of the driving elements performs a movement of the earth moving tool in a direction-synchronous manner with the adjusting movement of the control member.

When the control unit is designed in accordance with the present invention, a distribution of the control into two differently actuatable handles is dispensed with. Even when from ergonomical reasons two handles can be provided, they are arranged at two opposite sides of the single control member and fixedly connected with it, so that the operator can perform with these handles the control movements only in the same direction. The second factor which facilitates the control for the operator is that the adjusting movements of the control member is direction-synchronous to a desired movement of the earth moving tool. When it is necessary for the operator to lift the earth moving tool, he pulls the control member by at least one handle upwardly. When the earth moving tool must be moved forwardly from him, the operator moves the control member by the handles forwardly away from him. When the earth moving tool must be turned to the left or to the right, the operator also moves the control member by the handles to the left or to the right. When the earth moving tool, for example, an excavator scoop must perform a turning movement in direction toward the operator, the operator turns the control member in direction toward himself. When finally the turning movement in another direction must be performed, the operator turns the control member away from him in an opposite direction.

In accordance with another advantageous feature of the present invention the sensors are so associated with the control member that when a movement of the control member upwardly or downwardly is performed, at least one sensor is activated which acts on one driving element to provide the adjusting movement of the earth moving tool upwardly or downwardly. When the control member is moved forwardly or backwardly, another sensor is actuated which acts upon another driving element to perform the adjusting movement of the earth moving tool away from the operator and toward him. When the control member moves to the left or to the right, a further sensor is activated which acts on a further driving element to provide the adjusting movement of the earth moving tool from the operator to the left or to the right.

Advantageously, the control member can be supported turnably about a horizontal axis which extends transversely to the longitudinal direction of the earth moving machine. When the control member is turned forwardly or rearwardly, another sensor is actuated, which acts on another driving element to provide a turning movement of the earth moving tool or a part of the earth moving tool away from or toward an operator.

The construction in accordance with the present invention permits a non-trained worker to control earth moving machines with a great number of driving elements for the earth moving tool, since the control movements are rotation-synchronous with the desired movements of the earth moving tool. The practical testing of the invention has shown that because of this easily understandable direction-synchronous control of the earth moving tool through only one control member, non-trained operators can also be employed to perform completing functions which cannot be performed by a rotation-synchronous adjustment of the control member, but can be performed by pushbuttons arranged on the handle and actuatable by the thumb.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
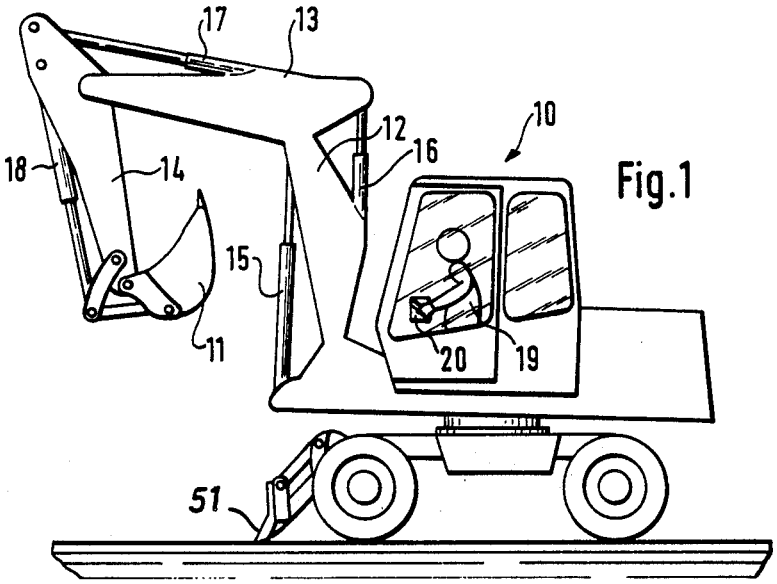
FIG. 1 is a view schematically showing an earth moving machine.

FIG. 1 shows an earth moving machine which is formed as an excavator 10. The excavator 10 has an excavating scoop 11 which in a known manner is arranged on a gripping arm which is composed of three individual arms 12, 13 and 14 turnably connected with one another. More particularly, the excavating scoop 11 is arranged on the last individual arm 14. Hydraulic cylinder-piston units 15, 16, 17 and 18 form drives which act on the scoop 11 and on each of three individual arms 12, 13 and 14. The cylinder-piston units 15, 16, 17, 18 are operated by a control which includes a control device 20. The control device 20 is actuated by an operator 19 who sits in the earth moving machine 10, by means of two hornlike handles 21 and 22.

Figure 3:
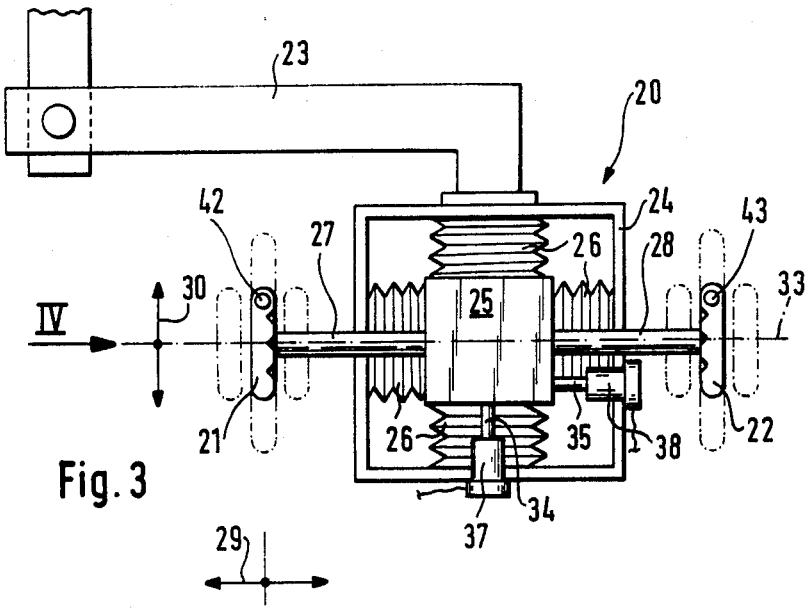
FIG. 3 is a view schematically showing the arrangement of a control member and associated sensors in a housing of the control unit in accordance with the present invention.
Figure 4:
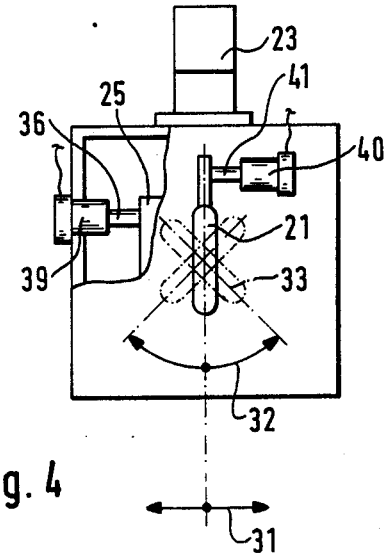
FIG. 4 is a view schematically showing the control unit which is turned relative to FIG. 3 by 90°, as seen in direction of the arrow IV in FIG. 3.

As shown in FIGS. 3 and 4, a control device 20 has a cubic control member 25 which is arranged in a housing 24. The housing is anchored on a chassis of the earth moving machine through a turning arm 23. Spring bellows 26 are arranged on six sides of the cubic control member 25. In normal condition they hold the control member in a center of the housing 24. The control member 25 is therefore floatingly supported between the spring bellows 26 in the housing 24.

Figure 2:
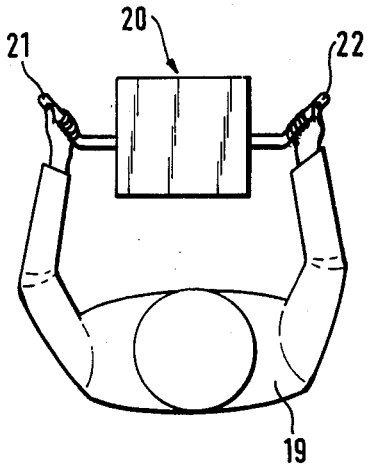
FIG. 2 is a view schematically showing an operator of an earth moving machine which activates a control unit in accordance with the present invention.

At two opposite sides of the control member 25, rods 27 and 28 are mounted and extend through the housing 24 outwardly beyond the latter. The handles 21 and 22 are arranged on the free ends of the rods 27 and 28 and can be grasped by the operator 19 as shown in FIG. 2. The double arrows 29 and 30 in FIG. 3 and dash-dot contour lines of the handles 21 and 22 illustrates that the handles 21 and 22 and thereby the control member 25 which is floatingly arranged in the housing 24 can be moved in the plane of the drawing by the operator to the left, to the right, forwardly or rearwardly and also inclined to these directions. The double arrows 31 and 32 in FIG. 4 illustrate the adjustability of the control member 25 perpendicularly to the plane of the drawing in FIG. 3 and an adjustability of the control member about a horizontal axis 33 in FIG. 3. The turning movement about the axis 33 is additionally identified by dash-dot contour lines of the handle 21.

The adjusting movement of the control member 25 produced through the handles 21 and 22 acts through sensing levers 34, 35, 36 which lie over the control member 25, upon electrical sensors 37, 38, 39. The electrical sensors are arranged in accordance with three space coordinates. A fourth electrical sensor 40 which is shown in FIG. 4 detects through a sensing pin 41 a turning movement of the control member 25 about the turning axis 33. The electrical signals supplied from the sensors 37, 38, 39, 40 act upon a known and not shown electrically actuatable proportional valve of the hydraulic drive of the earth moving machine, through which the cylinder-piston unit 15, 16, 17, 18 are actuated or controlled. Instead of the electrical sensors also hydraulic, pneumatic and mechanically actuating sensors can be utilized.

For releasing further control movements, both handles 21 and 22 can be additionally provided with pushbuttons 42 and 43 which are actuatable by thumb of one hand respectively. The connection of the electrical sensors 37, 38, 39, 40 and the pushbuttons 42, 43 with hydraulic proportional valves of the drive of the earth moving machine is selected so that an adjusting movement of the control member 25 causes a direction-synchronous adjusting movement of the earth moving tool, here the excavator scoop 11. When for example the control body 25 is moved upwardly from the plane of the drawing of FIG. 3 on the handles 21 and 22, this movement is converted through the electrical sensor 39 to a drive movement of the cylinder-piston units 15, 16 which are so arranged relative to one another that the excavator scoop 11 moves vertically upwardly. The control body 25 is freely spatially movable within predetermined limits which are determined by not shown abutments. In each of the possible spatial positions it is also turnable about the axis 33, whereby by movement of the control member also a simultaneous response of all electrical sensors 37, 38, 39, 40 can take place. While in the embodiment of FIG. 1 the earth moving tool is formed as the scoop 11, it can also be formed as an excavator gripper. Reference numeral 51 identifies the earth moving tool formed as a spade.

It will be understood that each of the elements described above, or two or more together, may also find a useful application in other types of constructions differing from the types described above.

While the invention has been illustrated and described as embodied in an earth moving machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An earth moving machine, comprising an earth moving tool; a plurality of drive elements arranged to move said earth moving tool in different directions; and control means operative for actuating said drive elements, said control means including a single control member which is freely movable from an initial position toward all sides and additionally turnable about at least one turning axle, said control means being further provided with at least one handle which is fixedly connected with said control member, said control means also having electrical sensors which respond to the movements of said control member in three mutually perpendicular directions and to the turning of the control member, said sensors being associated with said drive elements so that each of said drive elements causes a movement of said earth moving tool in a direction-synchronous manner with the movements and turning of said control member, said control member having a cubic shape, said control means including a housing mountable on a chassis of the earth moving machine and a plurality of spring bellows arranged at all six sides of said control member so that said control member is floatingly supported between said spring bellows in said housing, and urged toward a center of said housing.

2. An earth moving machine as defined in claim 1, wherein said control means include two such handles which are arranged at two opposite sides of said control member and fixedly connected with the latter, said handles being formed as control horns graspable by the hands of an operator.

3. An earth moving machine as defined in claim 1, wherein said drive elements include a drive element which is arranged to move said earth moving tool upwardly and downwardly, a drive element which is arranged to move said earth moving tool forwardly and rearwardly, and a drive element which is arranged to move said earth moving tool to the left and to the right, said sensors being formed so that when said control member is moved in one direction one of said sensors acts upon said drive element which moves said earth moving tool upwardly and downwardly, when said control member is moved in another direction another of said sensors acts on said drive element which moves said earth moving tool forwardly and rearwardly, and when said control member is moved in a further direction, a further of said sensors acts upon said drive element which moves said earth moving tool to the left and to the right.

4. An earth moving machine as defined in claim 1; and further comprising a chassis extending in a longitudinal direction, said control member being turnable about a horizontal axis which extends transversely to the longitudinal direction, said drive elements including at least one drive element which turns at least a portion of said earth moving tool away from and toward an operator, so that when said control body is turnable about said horizontal axis forwardly or rearwardly one of said sensors acts on said one driving element so that the latter turns at least a part of said earth moving tool away from and toward the operator.

5. An earth moving machine as defined in claim 4, wherein said earth moving tool is formed as an excavator scoop, said one driving element being arranged to turn said excavator scoop away from and toward the operator.

6. An earth moving machine as defined in claim 1, wherein said handle has a pushbutton actuatable by a thumb of an operator for releasing an additional movement of said earth moving tool.

7. An earth moving machine as defined in claim 1; and further comprising an additional such handle which is coupled with said first mentioned handle, each of said handles having a pushbutton which is actuatable by thumbs of an operator for releasing an additional movement of said earth moving tool.

8. An earth moving machine, comprising an earth moving tool; a plurality of drive elements arranged to move said earth moving tool in different directions; and control means operative for actuating said drive elements, said control means including a single control member which is freely movable three-dimensionally from an initial position toward all sides and additionally turntable about at least one turning axle, said control means being further provided with at least one handle which is fixedly connected with said control member, said control means also having electrical sensors which respond to the movements of said control member in three mutually perpendicular directions and to the turning of the control member, said sensors being associated with said drive elements so that each of said drive elements causes a movement of said earth moving tool in a direction-synchronous manner with the movements and turning of said control member, said control member having a cubic shape, said control means including a housing mountable on a chassis of the earth moving machine and a plurality of spring bellows arranged at all six sides of said control member so that said control member is floatingly supported between said spring bellows in said housing, and urged toward a center of said housing.

* * * * *